US005329735A

United States Patent [19]

Charlton et al.

[11] Patent Number: 5,329,735

[45] Date of Patent: Jul. 19, 1994

[54] SYSTEM FOR FORMING AND POLISHING GROOVES IN GLASS PANELS

[76] Inventors: Thomas J. Charlton, 250 S. Woodland Beach Rd., Camano Island, Wash. 98292; Trent R. Seed, 6053 5th Ave. NE., Seattle, Wash. 98115; Richard W. Seed, 2177 Killarney Way, Bellevue, Wash. 98004

[21] Appl. No.: 894,821

[22] Filed: Jun. 8, 1992

[51] Int. Cl.[5] ..... B24B 1/00; B24B 7/19

[52] U.S. Cl. ..... 51/283 R; 51/283 E; 51/327

[58] Field of Search ..... 51/283 E, 293 R, 326, 51/327, 328, 292, 400, 207, 102, 206 R

[56] References Cited

U.S. PATENT DOCUMENTS

| | | | |
|---|---|---|---|
| 2,623,332 | 12/1952 | Knaff | 51/283 |
| 2,626,363 | 1/1953 | Holmbeck | 51/283 |
| 3,802,130 | 4/1974 | Undenbeck | 51/207 |
| 3,919,811 | 11/1975 | Hedelin | 51/207 |
| 4,445,300 | 5/1984 | Sekiya | 51/283 R |
| 4,594,814 | 6/1986 | Olszewski | 51/283 E |
| 4,720,218 | 1/1988 | Pefries | 51/206 R |
| 4,841,676 | 6/1989 | Barwasser | 51/206 R |
| 4,945,687 | 8/1990 | Scheider | 51/400 |

FOREIGN PATENT DOCUMENTS

| | | | |
|---|---|---|---|
| 1484613 | 6/1989 | U.S.S.R. | 51/327 |
| 697556 | 6/1951 | United Kingdom | 51/400 |

*Primary Examiner*—Bruce M. Kisliuk
*Assistant Examiner*—Bo Bounkong
*Attorney, Agent, or Firm*—Seed and Berry

[57] ABSTRACT

A system for forming a polished groove in a glass panel has separate grooving apparatus and groove polishing apparatus. The grooving apparatus has a rotating grinding unit which moves endwise along its rotary axis to form a groove. This unit has a leading tapered section and a trailing cylindrical section containing a finer abrasive than the abrasive in the leading section. The formed groove has an arcuate transverse profile with a radius determined by the radius of the trailing section. The polishing apparatus has a rotating and oscillating buffing cylinder with a pile surface layer which is brought into engagement with the surface of the groove while wetted with a polishing liquid. The radius of the buffing cylinder approximates the radius of the groove profile.

18 Claims, 4 Drawing Sheets

SYSTEM FOR FORMING AND POLISHING GROOVES IN GLASS PANELS

DESCRIPTION

1. Technical Field

The present invention relates to apparatus and method for forming straight grooves in flat gloss panels by cutting (grinding) and polishing operations.

2. Background of the Invention

Flat glass panels are commonly grooved for decorative purposes. The grooving is normally accomplished by use of diamond grit grinding wheels which have a peripheral shape corresponding to the cross-section of the desired groove which is normally v-shaped. In the past the grooves have been cut by moving rotating grinding wheels over the glass panel with the rotary axis of the wheel parallel to the plane of the glass and at right angles to the direction of travel of the wheel. Normally two or more grinding passes are required with progressively finer grit sized wheels to obtain the desired groove depth and a smooth groove face.

It has been found that final polishing of the groove face to a luster equal to that of the glass planer faces cannot be achieved without a final polishing step involving buffing of the groove face with a buffing wheel while continuously wetted with a polishing liquid containing cerium oxide or an equivalent compound. Such a polishing liquid should be kept separated from the cooling liquid used during the groove cutting operation since both are normally recirculated. Heretofore the polishing operation has required use of a series of buffing wheels, commonly felt wheels, to attain a relatively quick polishing step achieving good surface luster. Even then, obtaining a consistently good polish over the entire area of the groove face in an efficient manner has been found to be difficult because of buffing wheel wear. If multiple buffing wheels are used to speed up the polishing operation uneven wear normally dictates independent height adjustment and independent removal of the wheels. This complicates the polishing apparatus.

The present invention aims to provide an improved groove cutting and polishing system by which only one pass of a grinding wheel unit is required to cut and finish a groove ready for final polishing, and which substantially improves the final polishing step.

SUMMARY OF THE INVENTION

In the practice of the present invention a straight groove is formed across a face of a flat glass panel by first forming the groove by a grinding step and then polishing the groove by a polishing step. These two steps are preferably performed at two separated work stations to keep the coolant used during the grinding step and the polishing liquid used during the polishing step separated from one another. The grinding step is performed by one pass of a special grinding wheel unit, and the polishing step is performed by a special buffing cylinder acting on the entire length of the groove while wetted by a suitable polishing liquid.

The grinding step is preferably performed by moving a grooving unit and a glass panel relative to one another so that the rotary axis of the grooving unit advances in the direction of the groove being formed rather than moving crosswise to such direction. To make this possible and to also make it possible to subject the glass to progressively decreasing grit sizes the grooving unit preferably consists of a plurality of coaxial grinding wheels mounted together on a rotary shaft. The lead grinding wheel or wheels perform a groove cutting operation and the trailing grinding wheel or wheels perform primarily a finishing (smoothing) operation. The lead grinding wheel is tapered so that the radius of the lead face of the wheel is smaller than the radius of the trailing face of the trailing grinding wheel by an amount which is greater than the preferred depth of the groove to be formed. In other words the lead wheel is tapered sufficiently so that the blunt forward face of the wheel does not engage the edge of the glass panel when the lead wheel initially engages the panel. The remaining wheels for the cutting operation are also preferably tapered. The remainder of the grinding wheels performing finishing of the groove faces are cylindrical. The rotary axis of the grinding wheel is preferably slightly tilted upwardly at the front to provide an attack angle for the finishing wheels. The radius of the grinding wheels is selected so that the segment of glass removed by the grooving unit has the desired depth and width.

The polishing step is performed by use of a buffing cylinder which is faced with a suitable buffing material such, for example, as nylon pile anchored in a rubber (neoprene) backing layer. Use of an additional intermediate rubber layer is preferred. The buffing cylinder is longer than the groove to be polished and is preferably simultaneously rotated and oscillated while in engagement with the surface of the groove. At the same time the buffing cylinder is continuously wetted by jets of water containing a suitable polishing compound which preferably is primarily cerium oxide.

The radius of the polishing cylinder is matched to that of the grooving unit such that the buffing material will engage the entire width of the surface of the groove. In actual practice the "give" of the buffing material, rubber backing, and intermediate rubber layers makes exact matching of the radii of the grooving unit and buffing cylinder unnecessary and compensates for wearing of the buffing material.

If, as is common, a pattern of crisscrossing grooves is desired consisting of grooves at right-angles to one another on a rectangular glass panel, it is preferred to polish one of the two sets of grooves on each of two panels simultaneously by use of one operation of the buffing cylinder. This is accomplished by mounting the two panels side-by-side with the corresponding sets of grooves aligned with one another so that the buffing cylinder can engage corresponding grooves at the same time.

DETAILED DESCRIPTION OF THE INVENTION

Figure 1:
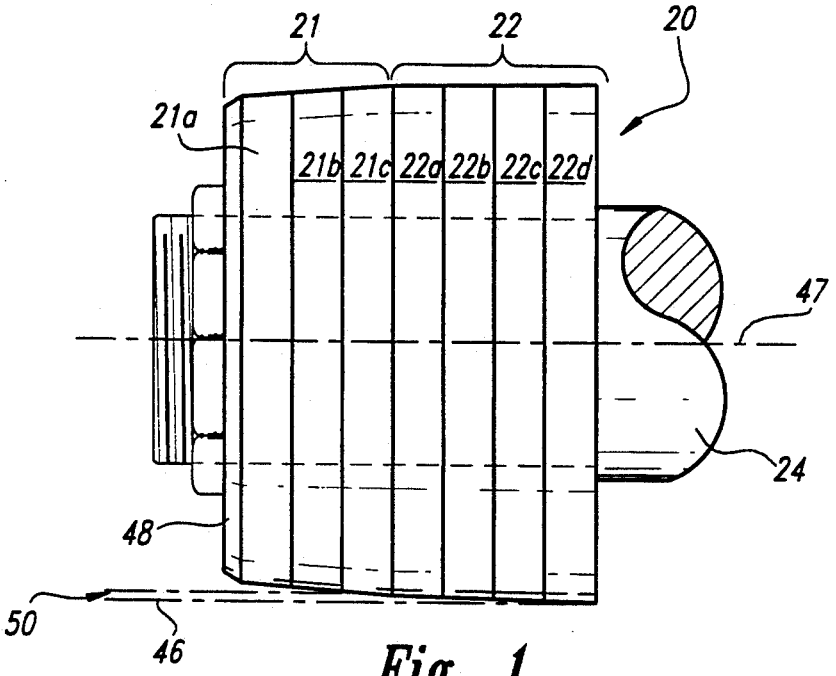
FIG. 1 is an elevational view of an improved grooving unit in accordance with the present invention.

The present invention involves groove forming and groove polishing operations on flat glass panels. Grooving of the glass is preferably performed by one pass of a grooving unit 20 which accomplishes the grooving by a grinding operation with diamond grit abrasives involving a series of two or more grit sizes. Referring to FIG. 1, the preferred grooving unit 20 has a tapered leading cutting section 21 and a trailing finishing section 22 which may be cylindrical. Both of these sections may comprise two or more coaxial grinding wheels abutting one another or separated by a gap to aid in exposure to a cooling liquid. For purposes of example the cutting section 21 is illustrated as comprising three tapered grinding wheels 21*a–c* and the finishing section 22 is shown as comprising four cylindrical grinding wheels 22*a–d*. The grinding wheels in the cutting section 21 may be 80 grit (U.S. mesh size) diamond wheels with a metal bond, and the grinding wheels in the finishing section 22 may be 800 grit (U.S. mesh size) diamond wheels with a metal bond. However, this is by way of example only, since various combinations of grinding wheels with decreasing grit sizes from the leading end to the trailing end of the grooving unit can be used.

The grinding wheels making up the grooving unit 20 are keyed to a forwardly projecting end portion of a rotary shaft 24 which may be directly driven by a hydraulic motor 25 at its trailing end. The shaft 24 is journaled in axially spaced bearings which are mounted in a pair of legs 26*a–b* provided by a vertical support unit 26. This unit has an upper shaft 26*c* which is mounted for turning adjustment by bearings 27, 28 on a horizontal carrier 30, and is connected at the top to a turning unit 32 on the carrier which is indexed to selectively turn the support unit to various cutting positions. The carrier 30 may be slidably mounted by a dove tail slide 34 on bridge 36 extending over a table 38 for holding a glass panel (pane), and is arranged to be moved back and forth along the bridge 36 by a servo driven feed screw 38 in a standard manner. The table 38 is slide mounted on a pair of rails 40 and is arranged to be moved back and forth beneath the bridge 36 by a suitable servo driven drive mechanism such as a feed screw 42 in a standard manner. The overall function of the described mechanism is to enable the grooving unit 20 and a panel of glass on the table to be moved relative to one another in a controlled manner along a selected linear path, and it will be apparent that other well known mechanisms in the machine tool art can also be used for this purpose.

Figure 3:
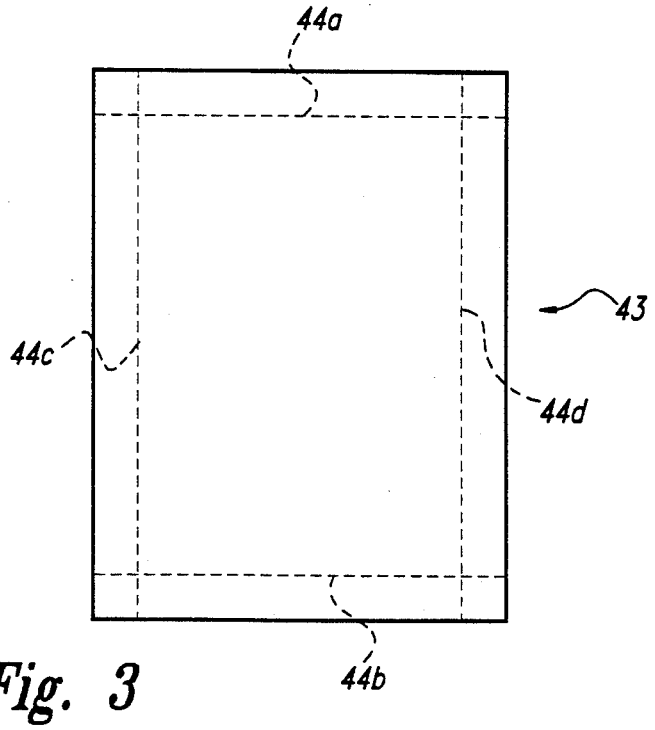
FIG. 3 is a plan view of a glass panel showing a pattern of grooves to be cut and polished.
Figure 5:
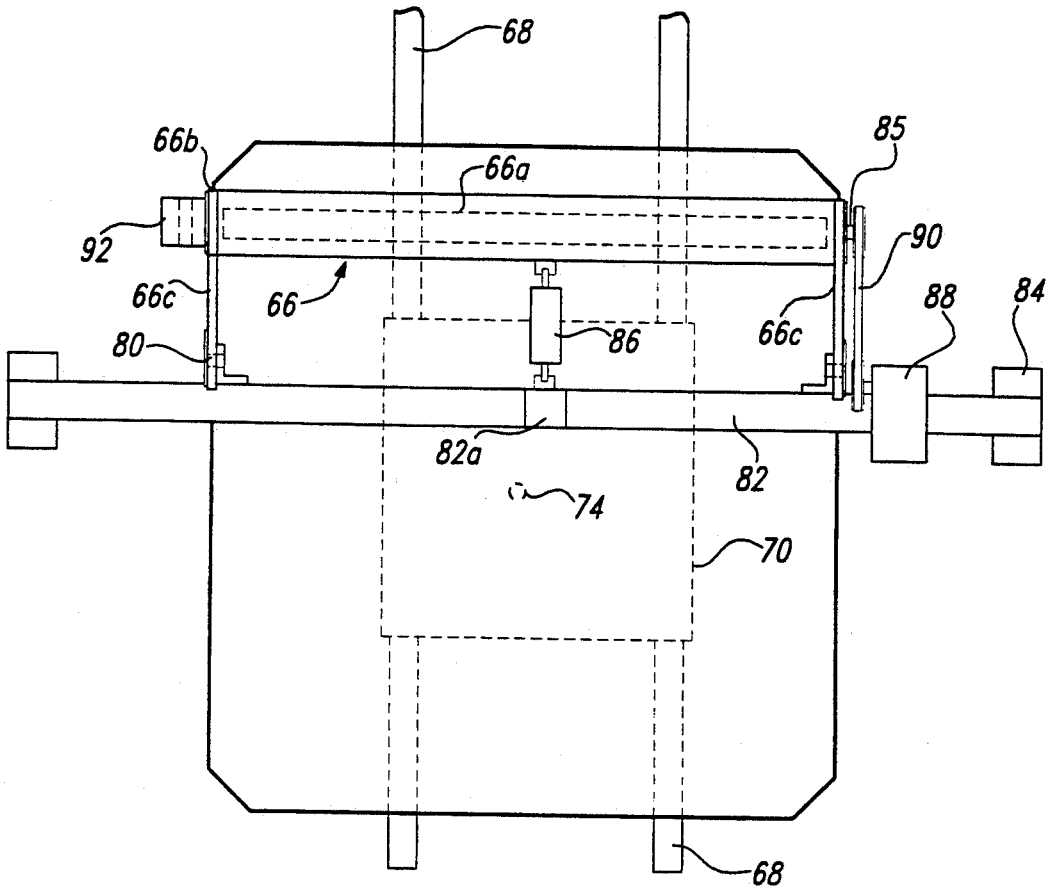
FIG. 5 is a top plan view of a polishing machine embodying the present invention.
Figure 6:
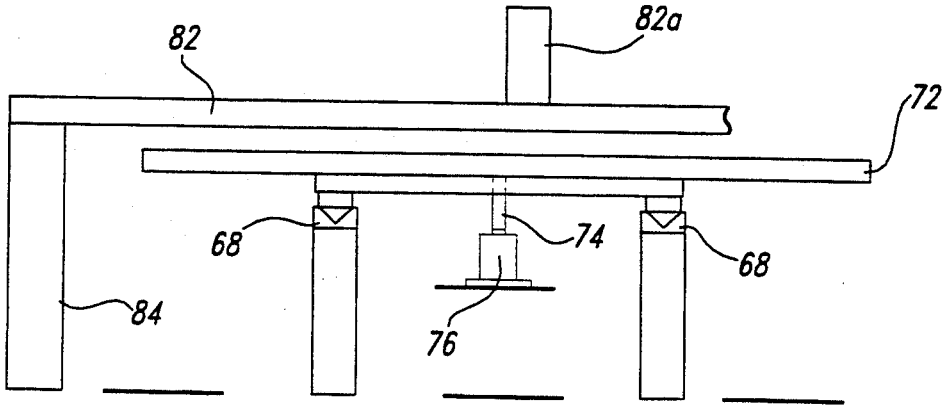
FIG. 6 is a fragmentary front elevational view of the polishing machine.

Typically it will be desired to form a pattern of crossing grooves in a rectangular glass panel 43. For purposes of example the pattern is shown in FIG. 3 by broken lines as comprising a pair of upper and lower parallel grooves 44*a–b* crossed at right angles adjacent the corners of the panel 43 by a pair of parallel side grooves 44*c–d*. All of the grooves 44*a–d* extend completely across the panel from one edge to an opposite edge. Hence, at the start of each groove the grinding unit 20 engages an edge of the glass. Accordingly, the cutting section 21 is given an angle of attack sufficient to elevate the forward end of the cutting section above the plane 46 of the upper surface of the glass panel to be grooved. This angle of attack is primarily defined by tapering at least the leading portion of the cutting section, and is secondarily defined by slightly tilting the rotary axis 47 of the grooving unit upwardly at its leading end. The primary function of this axis tilting is to provide a small attack angle for the cylindrical grinding wheels 22*a–d* in the finishing section 22.

For purposes of example, the seven grinding wheels in the grooving unit 20 each may be 0.5 inches thick and may be separated by spacers 0.0625 inches thick (not shown). The four grinding wheels 22*a–d* in the finishing section 22 each may have a diameter of 4.3 inches and the three grinding wheels in the cutting section may collectively taper from 4.25 inches to 4.3 inches. Additionally, it is preferred to further taper a leading portion 48 of the front grinding wheel 21*a* so that for purposes of the foregoing example, its leading end has a diameter reduced to about 4.21 inches. The upward tilt angle 50 of the rotary axis 47 may be about 1.5 to 2 degrees from the plane 46 of the glass over the length of the grooving unit 20 in the example. This tilt angle 50 and the taper of the cutting section 21 has been exaggerated in FIG. 1 for illustrative purposes. A grooving unit 20 with the above described dimensions may be used to form a groove which has a maximum depth of about 0.040 inches and an entry width of about 0.75 inches. For this result the height of the grooving unit 20 is set so that the bottom of the trailing end of the trailing grinding wheel 22*d* is 0.040 inches below the level of the plane defined by the upper face of the glass panel. When the grinding wheels of the grooving unit have the aforesaid diameters it is preferred to rotate them at a speed of about 4,500 rpm.

Figure 4:
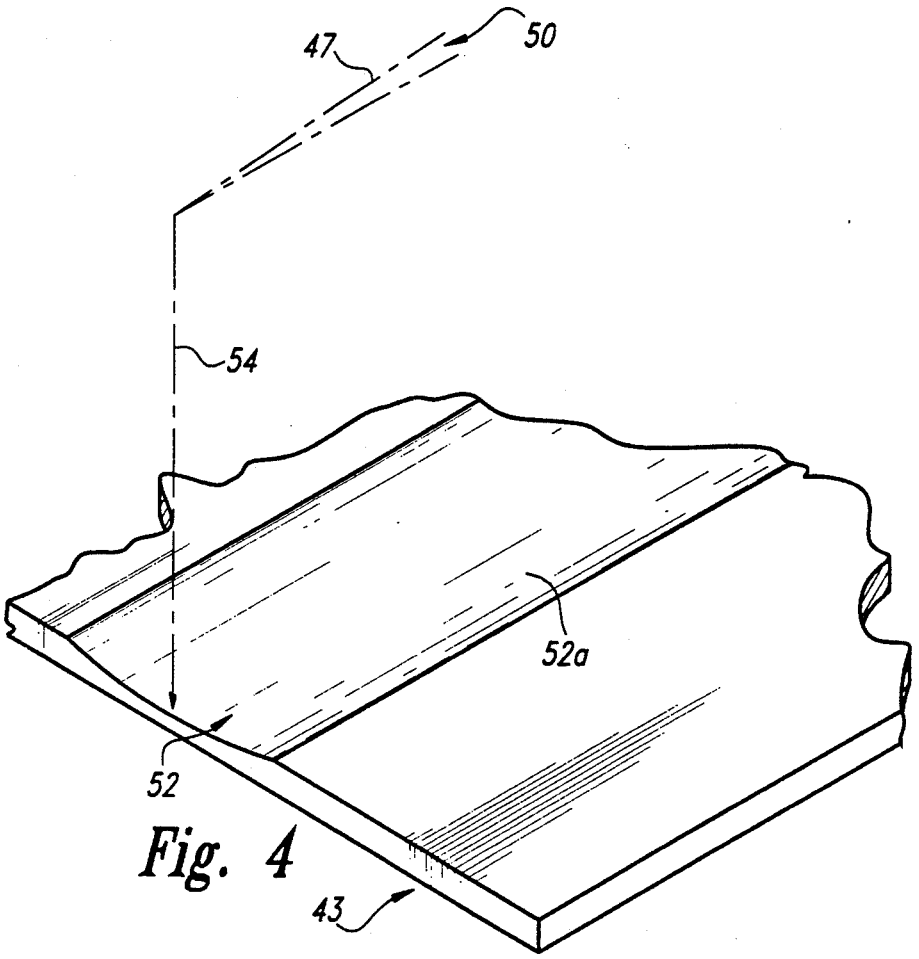
FIG. 4 is a fragmentary perspective view of a glass panel in which a groove has been formed by the present invention.

It will be appreciated that in the foregoing example as the grooving unit 20 is advanced into engagement with an edge of a glass panel 43, the tapered faces of the leading grinding wheel 21*a* will commence a groove 52 (FIG. 4) which will gradually increase in depth as the next two grinding wheels 21*b*, 21*c* in the cutting section 21 advance into engagement with the glass panel. Little glass remains in the formed groove to be removed by the grinding wheels 22*a–d* in the finishing section 22, their primary function being to smooth the face 52*a* of the groove 52 to an extent minimizing the amount of polishing then required to give the groove face 52*a* the same luster as the glass panel faces.

It will be appreciated that the grooving unit 20 forms a groove face 52*a* which has a transverse arcuate profile (see FIG. 4) having a radius of curvature 54 defined for practical purposes by the radius of the trailing grinding wheel 22*d* in the grooving unit, and namely, 2.15 inches in the previously described example. Technically, the radius of curvature may be very slightly less than this radial dimension because of the slight upward tilt 50 of the rotary axis 47 of the grooving unit 20.

Figure 2:
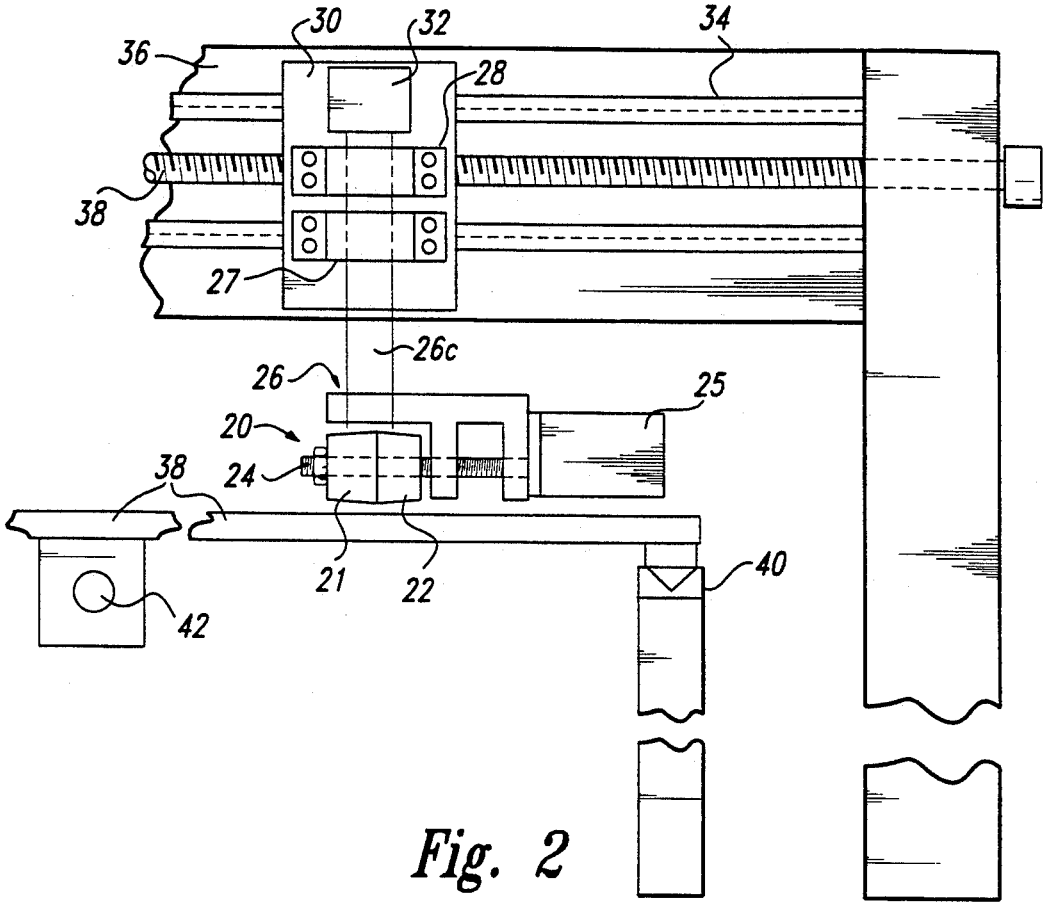
FIG. 2 is a fragmentary front elevational view of a grooving machine utilizing the improved grooving unit.

When the grooving unit 20 has completed a groove 52 and cleared the glass panel, the table 38 and/or grooving unit can be maneuvered to cut another groove. For example, if the glass panel 43 were positioned on the table 38 with the length of the panel parallel to the rails 40, the first groove 44*a* could be formed by moving the grooving unit 20 along the bridge 36 to the left in FIG. 2 with the grooving unit aimed transversely of the table 38 as shown. A second groove 44*c* extending lengthwise of the panel can then be cut after retracting the table 38 a short distance, turning the grooving unit counter-clockwise a quarter turn, and moving the grooving unit 20 back along the bridge 36 to a position aligned with the preselected position of the second groove. The table 38 is then advanced toward the bridge so that the rotating grooving unit forms the second groove 44*c*. The remaining two grooves 44*b* and 44*d* can then be formed in a similar manner. It will be appreciated that the servo motors driving the grooving unit 20 along the bridge 36, driving the table relative to the bridge, and powering the turning mechanism 30 on the bridge for the grooving unit, can be programmed to automate operation of the grooving unit to form a given pattern of grooves on a glass panel of a given size.

During operation of the grooving unit the grinding wheels are continuously supplied with cooling liquid through one or more tubes (not shown) mounted on the support unit 26 and aimed at the grinding wheels. The cooling liquid is pumped from a reservoir to the tubes and is collected from the table in a border trough (not shown) and returned to the reservoir. Glass particles in the returning cooling liquid are filtered out at the top of the reservoir. It is preferred to shroud the grooving unit 26 during operation to confine the spray of the cooling liquid engaging the grinding wheels.

Although the grooving unit has been described as comprising multiple grinding wheel units, it will be appreciated that this is by way of example only. The cutting section 21 and finishing section 22 could each be a single grinding wheel for example.

Figure 7:
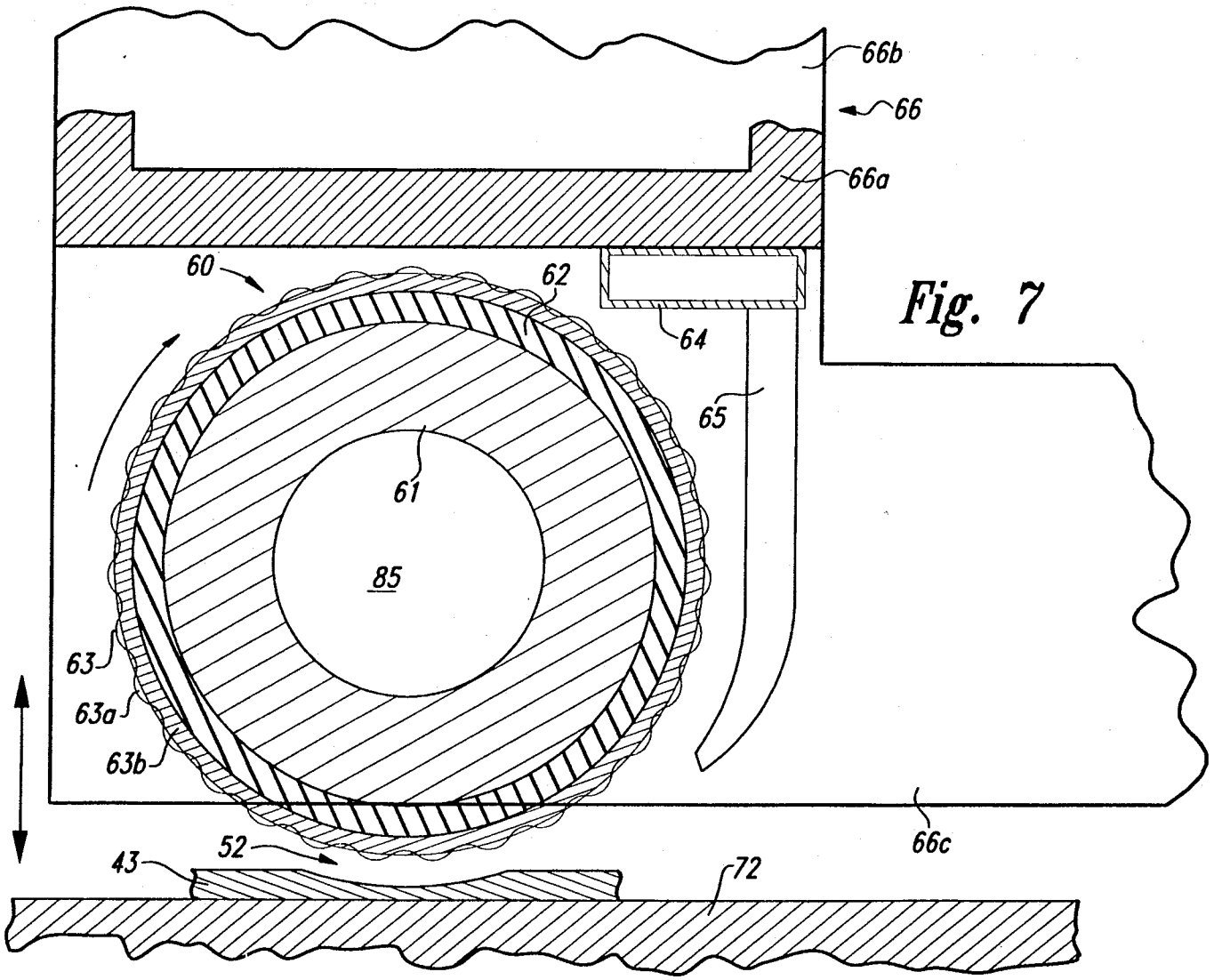
FIG. 7 is a fragmentary detail vertical sectional view to an enlarged scale taken as indicted by line 7—7 in FIG. 5.

The second stage of the groove making system involves use of a novel polishing machine which incorporates an elongated buffing cylinder 60 which has an effective radius defined by the radius of curvature 54 of the face 52*a* of the groove 52 formed during the initial groove cutting and finishing stage. As shown in FIG. 7, this buffing cylinder comprises a rigid cylindrical tube 61 covered with an intermediate resilient rubber layer 62, and an outer pile layer 63. The pile layer is preferably a dense looped nylon pile 63*a* anchored in a rubber (neoprene) backing 63*b*, and may comprise a high grade of nylon carpeting of the type having a rubber backing. The pile layer 63 is preferably applied by spiral winding a strip about three inches wide onto the cylinder and anchoring its ends to the cylinder in any suitable manner as with duct tape. The rubber backing 63*b* of the pile layer 63 may be mounted directly against the cylinder 61, but it is preferred to increase the depth of the rubber by providing the additional intermediate rubber layer 62.

If, for example, if the groove face 52*a* to be polished has a radius of curvature 54 of 2.15 inches in accordance with the previously described example, the cylinder 61 may have an outside diameter of 3.5 inches, the rubber layer 62 may have a thickness of 0.20 inches, and the pile layer 63 (including its backing) may have a relaxed thickness of about 0.25 inches, giving the buffing cylinder 60 a radius of curvature 54 slightly greater than that of the groove face 52*a*. However, when the buffing cylinder is pressed into the groove 52, in the manner to be described, the pile 63*a* is pushed firmly against its backing 63*b*, and the backing and intermediate rubber layer 62 are compressed sufficiently in the groove to provide engagement of the pile 63*a* with the entire surface of the groove. This engagement by the pile with the entire groove surface continues during wearing of the pile because of the resilience of the rubber between the pile and the rigid cylinder 61 even when the wear is such that the overall radius of the buffing cylinder unit becomes somewhat less than the radius of curvature of the groove face. There of course comes a point where the efficiency of the pile is reduced by wear to the point that it is replaced.

The pile of buffing cylinder is continuously wetted during operation by a suitable polishing liquid preferably containing cerium oxide or the like. This polishing liquid is pumped from a reservoir to a manifold extending lengthwise of the buffing cylinder 60 and presenting a plurality of jet tubes 65 at regular intervals which are aimed at the buffing cylinder close to the entry region of the buffing cylinder into the groove being polished as indicated in FIG. 7.

The buffing cylinder and polishing liquid manifold are mounted on a swing frame 66 extending over and laterally beyond a pair of rails 68 which slideably carry a carriage 70 which is centrally connected to a servo driven feed screw (not shown). A table 72 is mounted on a center shaft 74 journaled on the carriage so that when the table 72 is slightly lifted from resting on the carriage 70 it can be easily turned ninety degrees, for example. The center shaft 74 has a bottom thrust bearing and may be lifted in any suitable manner such as by a hydraulic cylinder 76. When the table 72 is lowered in its proper selected position a locking pin may be used to hold it against rotation.

The swing frame 66 comprises a tubular header 66*a* having a pair of end plates 66*b* which depend opposite the ends of the buffing cylinder 60 and have swing arm extensions 66*c*. These swing arms extend horizontally to pivots 80 provided by a bridge 82 mounted on columns 84.

At its ends the cylinder 61 of the buffing cylinder 60 has stub shafts 85 extending through suitable bearings mounted on the depending portions of the end plates 66*b* of the swing frame 66 which permit both rotary and oscillating movement of the buffing cylinder 60 relative to the swing frame. The swing frame 66 provides vertical adjustment to raise and lower the buffing cylinder 60 relative to the table 72. This may be accomplished by operation of a pneumatic cylinder 86 extending between the header 66*a* and an upwardly projecting member 82*a* on the bridge 82. Operation of the cylinder 86 rocks the swing frame 66.

The buffing cylinder 60 is rotated during its buffing activity as by a hydraulic motor mounted on the bridge 82 and having a flexible belt drive 90 to the respective stub shaft 85. At its opposite end the buffing cylinder 60 has its respective stub shaft 85 complied to a double-acting pneumatic cylinder assembly 92 which provides oscillating axial movement of the buffing cylinder while its is being rotated at a speed of about 1750 rpm by the hydraulic motor 88 and belt drive 90. The compressed air supply to the pneumatic cylinder assembly 92 may be controlled by a suitable spring-loaded, solenoid-operated shuttle valve (not shown) which has its solenoid electrically connected to an adjustable timing mechanism (not shown) to periodically activate the solenoid. Activation of the solenoid results in supplying compressed air to one end of the piston in the pneumatic cylinder 92 and venting the opposite end, and deactivation of the solenoid results in supplying compressed air to the second end of the piston and venting the first end. The resulting shuttling of the piston causes oscillation of the buffing cylinder 60. Preferably the oscillation stroke is about one inch long.

The polishing liquid sprayed onto the buffing cylinder 60 through the spray tubes 65 is collected from the table by a collection system (not shown) including a trough about the table which connects by a flexible hose or hoses to a collection manifold dumping into a reservoir from which the polishing liquid is pumped for recirculation to the manifold 64 mounted on the header 66*a*. Skirting to confine spray of the polishing liquid by action of the polishing cylinder may be suspended from the header 66*a*.

Preparatory to operation of the polishing cylinder a grooved glass panel is positioned on the table 72 with one or more of its grooves 52 parallel to the polishing cylinder. Adjustable stops (not shown) can be used to engage the edges of the glass panel to a height lower than the level of the bottom of the grooves in the panel and retain the panel in proper position. These stops may screw directly into the table, or may be of the type which clamp within slide grooves in the table.

After the grooved glass panel is mounted on the table 72 the table is advanced, as by use of a standard feed screw drive (not shown), to position the groove 52 to be polished directly beneath the polishing cylinder 60 as shown in FIG. 7. The polishing cylinder is then lowered into the groove and activated to both rotate and oscillate while supplied with polishing liquid. As a result the entire length and surface of the groove is quickly polished. The buffing cylinder 60 is then raised out of the polished groove and the table 72 is advanced by movement of the carriage 70 so that the next unpolished groove is positioned beneath the polishing cylinder. The polishing step is then repeated. When the group of unpolished grooves which are at right angles to those grooves now polished are to be polished, the table 72 is raised by the hydraulic cylinder 76, rotated a quarter turn, and then lowered into a second position locating the second group of grooves in parallel relation to the buffing cylinder. Polishing of the second group then proceeds in the same manner as the first group.

If two glass panels have like groups of transverse grooves, they can be positioned side by side on the polishing table 72 with corresponding of the transverse grooves in each panel in alignment with those in the other panel. Then the transverse corresponding grooves in both panels can be simultaneously polished by the buffing cylinder 60 thereby shortening the polishing time required for each of the panels.

Reviewing the groove forming and polishing operations it is seen that such involves practice of a two-step method, namely, (1) forming a linear groove in the glass panel which has an arcuate transverse profile with a given radius of curvature, and (2) polishing the entire length of the groove with a rotating buffing cylinder having approximately the same radius of curvature and wetted with a polishing liquid. Preferably the buffing cylinder is also axially oscillated during the polishing operation and has a buffing pile with a resilient backing. Although it is preferred to form the grooves with the previously described grooving unit, the practice of the two-step method is not intended to be limited to use of this grooving unit. Also, although nylon pile anchored in a rubber (neoprene) backing is presently preferred for the buffing cylinder, other non-abrasive pile material which is well anchored in a suitable backing can be used.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method for forming a polished rectilinear groove in a glass panel having a continuous peripheral edge surrounding a flat face, said method comprising:

grinding an elongated rectilinear groove in said panel across said flat face with a grinding unit having an abrasive surface shaped and positioned such that said groove has a concave surface with a constant transverse profile merging with said flat face at longitudinal side edges of the groove which are spaced from said peripheral edge except at the ends of the groove;

and polishing the surface of said groove with a rotating buffing cylinder simultaneously engaging substantially the entire surface of said groove and having a longitudinal center rotary axis parallel to said groove;

and supplying polishing liquid to said buffing cylinder while it is engaging said groove surface.

2. A method according to claim 1 in which said transverse profile is arcuate and has a radius of curvature.

3. A method according to claim 2 in which said buffing cylinder has said rotary axis spaced from its periphery by a radial distance approximately the same as the length of said radius of curvature.

4. A method according to claim 1 in which said buffing cylinder has an outer cylindrical pile buffing layer backed by an elastomeric layer, aid buffing layer engaging said groove surface while being polished.

5. A method according to claim 1 in which said buffing cylinder is longitudinally oscillated along said rotary axis while being rotated.

6. A method according to claim 1 in which a second glass panel with a flat face is provided, and a second rectilinear groove like the first-mentioned groove is formed across said flat face of the second glass panel by said grinding unit, and said two panels are then positioned with their said flat faces coplanar and said grooves in alignment with one another;

and in which said buffing cylinder simultaneously engages and polishes the surfaces of both of said grooves.

7. A method according to claim 1 in which said groove is formed by moving a rotating generally cylindrical grinding unit with a tapered leading section endwise relative to said panel and in contact with said flat face such that the rotary axis of the grinding unit is aimed in a direction generally parallel to said flat face.

8. A method according to claim 7 in which said rotary axis is slightly tilted upwardly at the leading end of said grinding unit relative to said flat face of the glass panel.

9. A method according to claim 7 in which said grinding unit has a trailing section which contains finer abrasive material than said leading section contains.

10. A method according to claim 7 in which said grinding unit and buffing cylinder have approximately the same diameter.

11. A method according to claim 1 in which said grinding unit is generally cylindrical and said grinding unit and buffing cylinder have approximately the same outer diameter.

12. A method according to claim 1 in which a second rectilinear groove like the first-mentioned groove is ground across said flat face at cross-angles to the first-mentioned groove before the first-mentioned groove is polished, and in which said second groove is polished int he same manner as said first-mentioned groove after repositioning said buffing cylinder and glass panel relative to one another in accordance with the cross-angle between said grooves after the first-mentioned groove has been polished.

13. A method for forming a groove in a glass panel having a flat face, said method comprising:

moving a rotating grinding unit with a frusto-conical leading grinding section and a cylindrical trailing grinding section endwise relative to said panel in engagement with said flat face such that its rotary axis is aimed in a direction generally parallel to said flat face and is tilted upwardly slightly relative to said flat face at the leading end of said leading section, said trailing section being the rearmost grinding section in the grinding unit and having its grinding material finer than the grinding material in said leading section.

14. A method for polishing a rectilinear groove formed in a flat face of a sheet of glass, the surface of the groove having an arcuate transverse profile and being spaced from the periphery of the glass sheet except at the ends of the groove, said method comprising:

polishing said groove surface with a rotating buffing cylinder having a generally cylindrical buffing surface simultaneously engaging substantially the entire said groove surface; and supplying polishing liquid to said buffing surface of said cylinder while it is in engagement with said groove surface.

15. A method according to claim 14 in which said buffing cylinder has an outer pile buffing layer providing said buffing surface.

16. A method according to claim 15 in which said pile buffing layer is backed by an elastomeric layer.

17. A method according to claim 14 in which said buffing cylinder is longitudinally oscillated parallel to said groove while rotating.

18. A method according to claim 14 in which said buffing surface has a length at least as long as said groove.

* * * * *